United States Patent [19]

Kato et al.

[11] 4,302,514

[45] Nov. 24, 1981

[54] CONTACT FOR VACUUM INTERRUPTER

[75] Inventors: Masaru Kato; Hitoshi Takeuchi; Toshiaki Horiuchi, all of Amagasaki, Japan

[73] Assignee: Mitsubishi Denki Kabushiki Kaisha, Tokyo, Japan

[21] Appl. No.: 41,559

[22] Filed: May 23, 1979

[30] Foreign Application Priority Data

May 31, 1978 [JP] Japan ..... 53-66192

[51] Int. Cl.[3] ..... B22F 7/00

[52] U.S. Cl. ..... 428/569; 428/567; 428/568; 75/248

[58] Field of Search ..... 75/248; 428/569, 568, 428/567

[56] References Cited

U.S. PATENT DOCUMENTS 2,983,996 5/1961 Neely et al. ..... 428/569
3,382,066 5/1968 Kenney et al. ..... 75/208 R
3,929,424 12/1975 Krock et al. ..... 428/569
4,123,265 10/1978 Takahashi et al. ..... 428/569

FOREIGN PATENT DOCUMENTS 836115 3/1970 Canada .

*Primary Examiner*—Brooks H. Hunt
*Attorney, Agent, or Firm*—Oblon, Fisher, Spivak, McClelland & Maier

[57] ABSTRACT

A contact for a vacuum interrupter has excellent characteristics of high withstand voltage, low melt bonding property, large current durability and low chopping current and is prepared by uniformly distributing, in a copper matrix, two kinds of high melting point metal powders having a melting point of higher than 1450° C. which have different particle diameters of (1) 80–300 μm and (2) less than 30 μm. The low chopping current characteristic is imparted by incorporating more than 10 wt. % of the high melting point metal powder. The high melting point metal powder can be selected from the group consisting of Cr, W, Mo, Ir and Co.

6 Claims, 4 Drawing Figures

MELT BENDING PROPERTY, Kg
300
200
100
0
50
100
150
200
250
DIAMETER OF CHROMIUM POWDER, μm

ARCING TIMES
100
50
0
50
100
150
200
250
DIAMETER OF CHROMIUM POWDER, μm

CHOPPING CURRENT, A
10
5
0
max
min
5
10
15
20
25
CONTENT OF CHROMIUM, W%

CHOPPING CURRENT, A
MELT BENDING PROPERTY, Kg
ARCING TIMES
ARCING TIME
CHOPPING CURRENT
MELT BENDING PROPERTY
10
5
0
400
300
200
100
100
50
a
b
c
KINDS OF CONTACT

CONTACT FOR VACUUM INTERRUPTER

BACKGROUND OF THE INVENTION

1. Field of the Invention

The present invention relates to a contact for a vacuum interrupter which has excellent characteristics of high withstand voltage, low melting bonding property, large current durability and low chopping current.

2. Description of the Prior Arts

The important characteristics of a contact for a vacuum interrupter include:

(1) high interrupting property of a current interrupter;

(2) high withstand voltage;

(3) small contact resistance;

(4) low melt bonding property;

(5) low erosion of a contact; and (6) small chopping current.

It has been difficult to obtain a contact which is practically used and has all satisfactory characteristics. Accordingly, it has been considered to use a contact which has certain important characteristics even though the contact has inferior characteristics for other features depending upon its usage for a vacuum interrupter.

For example, a copper-bismuth alloy (Cu-Bi) has been mainly used for a contact for a vacuum interrupter.

According to our experience, a contact made of the Cu-Bi alloy containing less than 0.5 wt.% of Bi has large chopping current whereas a contact made of the Cu-Bi alloy containing more than 0.5 wt.% of Bi has relatively low withstand voltage.

When the chopping current is large, there is a possibility to cause abnormal voltage between contacts. When the withstand voltage is low, the contact can not be used in a high voltage circuit.

SUMMARY OF THE INVENTION

It is an object of the present invention to provide a contact for a vacuum interrupter which has excellent characteristics of high withstand voltage, low melt bonding property, large current durability and small chopping current.

The foregoing and other objects of the present invention have been attained by providing a contact for a vacuum interrupter which is made of an alloy prepared by uniformly distributing, in a copper matrix, two kinds of high melting point metal powders having each melting point of higher than 1450° C. which have different particle diameter of (1) 80–300 μm and (2) less than 30 μm.

DETAILED DESCRIPTION OF THE PREFERRED EMBODIMENTS:

Copper-chromium contacts will be illustrated by certain experimental results.

The melt bonding force of the copper-chromium contact is reduced depending upon increasing the diameter of chromium powder in the case of the same ratio of chromium to copper.

Figure 1:
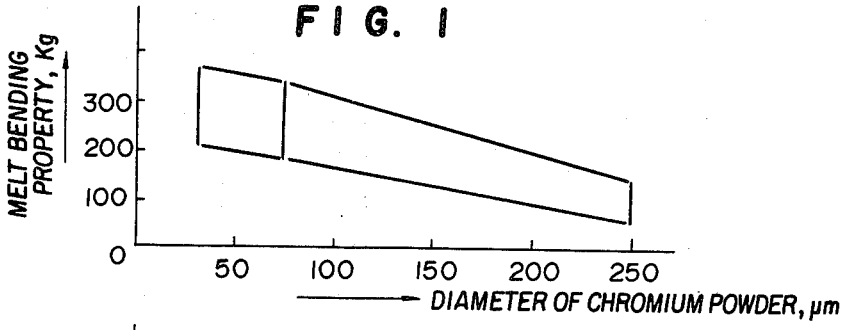
FIG. 1 is a graph showing the relation of diameters of chromium powder in copper-chromium contacts and melt bonding property.

FIG. 1 shows the relation of the diameters of chromium powder in copper-chromium contacts and melt bonding property in the specific condition.

The specific condition means that the current, the time for passing current and the ratio of chromium to copper are the same ones.

It is understood, from the result, that the melt bonding property of the copper-chromium contact is reduced depending upon increasing the diameter of the chromium powder.

It is clearly understood from FIG. 1 that the melt bonding property is remarkably low in the case of more than 80μm of the diameter of the chromium powder.

According to a microscopic observation of a cleavage plane formed by forcibly separating the melt bonded copper-chromium contacts, it is found that the cleavage is formed at three kinds of positions; the copper itself, the interface between the chromium powder and copper and the chromium powder itself. (The orders of breaking strengths of the cleavage positions are said orders).

This fact indicates that the melt bonding property or the breaking strength of the copper-chromium alloy is reduced depending upon increasing the diameter of the chromium powder.

On the other hand, the distribution density of the chromium powder to copper is increased and the thermal capacity of chromium itself is lowered depending upon decreasing the diameter of the chromium powder in the case of the same ratio of chromium to copper. Accordingly, a solid solution of copper-chromium alloy is easily formed at the melt bonded positions, whereby the melt bonding property or the breaking strength of the copper-chromium alloy is increased.

The withstand voltage of the copper-chromium alloy is increased depending upon decreasing the diameter of the chromium powder in the case of the same ratio of chromium to copper. These experimental results are found.

Figure 2:
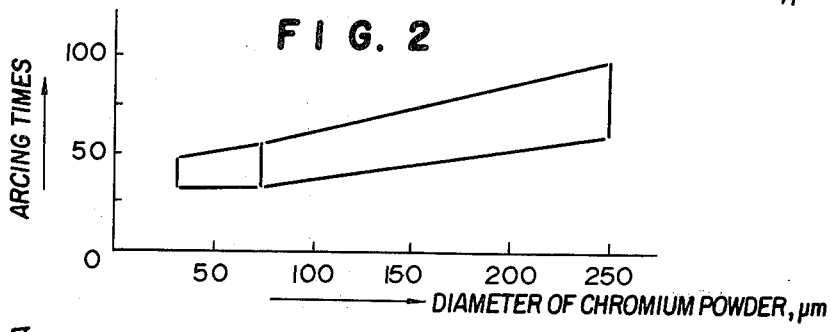
FIG. 2 is a graph showing the relation of diameters of chromium powder in copper-chromium contacts and withstand voltages.

FIG. 2 shows the relation of diameters of chromium powder in copper-chromium contacts and withstand voltages.

The characteristics shown in FIG. 2 indicate the relation of the diameters of the chromium powder and arcing times between the copper-chromium contacts having the same ratio of chromium to copper under the condition of the same voltage, the same times for applying the voltage.

From the characteristics, it is understood that the withstand voltage of the copper-chromium contact is increased depending upon decreasing the diameter of the chromium powder. This phenomemon is resulted by the reason that chromium has remarkably higher withstand voltage is vacuum than that of copper and the dispersed distribution of the chromium powder in copper is improved depending upon decreasing the diameter of the chromium powder.

As shown in FIG. 2, the withstand voltage is remarkably high in the case of less than 30 μm of an average diameter of the chromium powder.

In accordance with the above-mentioned experimental result, a contact having high withstand voltage and large current durability is obtained by combining two kinds of high melting point metal powder (e.g. Cr) having different diameters with the copper matrix. The melt bonding property of the contact can be reduced by the effect of the high melting point metal powder having larger diameter of particles. The withstanding voltage of the contact can be improved by the effect of the high melting point metal powder having smaller diameter of particles.

According to experiments, it has been confirmed that metals having a melting point of higher than 1450° C. such as Cr, Fe, W, Mo, Ir and Co can be preferably used as the high melting point metal powder.

The high melting point metal can be only one or a mixture of these metals. It is also possible to be an alloy powder having at least one element selected from the group consisting of Fe, W, Ir, Cr and Co.

In accordance with the present invention, the contact for a vacuum interrupter is formed by uniformly distributing, in a copper matrix, two kinds of the high melting point metal powders having a melting point of higher than 1450° C. which have different particle diameters of (1) 80–300 μm and (2) less than 30μm.

The copper-chromium contact of the present invention can be prepared by a powdery metallurgy.

The second feature of the present invention is to provide a copper-chromium contact formed by uniformly distributing, in a copper matrix, more than 10 wt.% of two kinds of high melting point metal powders having a melting point of higher than 1450° C. which have different particle diameters of (1) 80–300μm and (2) less than 30μm.

According to experiments, it has been found that at least about 10 wt.% of chromium powder is required for imparting satisfactory low chopping current in the case of the copper-chromium contact.

The present invention has been illustrated by the embodiments of copper-chromium contacts. However, it is clear that the same consideration can be applied for the contacts made of copper, the other high melting point metal powders (two kinds of particle sizes.).

Figure 3:
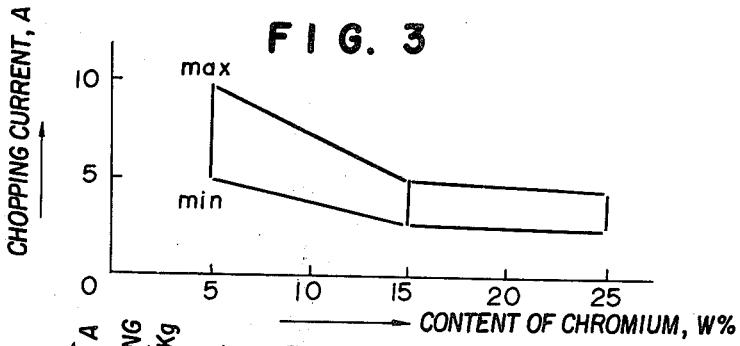
FIG. 3 is a graph showing the relation of contents of chromium and copper-chromium contacts and chopping currents.

FIG. 3 shows the relation of contents of the chromium powder (wt.%) in the copper-chromium contact and chopping currents in the case measuring for 50 times in the same circuit and the same conditions.

It is clearly understood that the chopping current of the copper-chromium contact is reduced depending upon increasing the content (wt.%) of the chromium powder.

When the content of the chromium powders is more than 10 wt.%, the chopping current is remarkably low.

This phenomenon is resulted by the fact that (1) the copper matrix is separated by the chromium powder at higher degree when the copper-chromium contact having a content of the chromium powder of at least 10 wt.% is compared with the copper-chromium contact having less content of the chromium powder, and (2) the conductivity of chromium is remarkably lower than that of copper whereby the load current is mainly shunt to the copper matrix. That is, the chopping current of the copper-chromium contact is reduced depending upon rising the temperature of the copper matrix in the case of the same load current.

Figure 4:
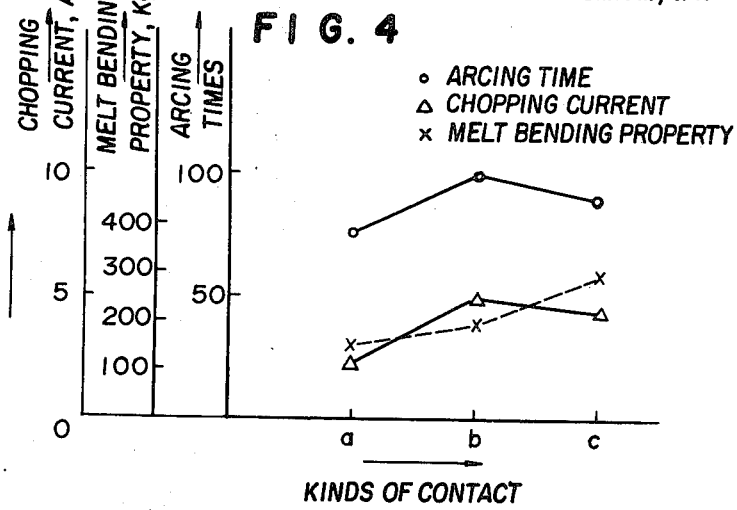
FIG. 4 is a graph showing chopping currents, melt bonding properties and withstand voltages of the copper-chromium contacts of one embodiment of the present invention and the conventional copper-chromium contacts.

FIG. 4 shows chopping currents, melt bonding properties and withstand voltages of the copper-chromium contacts of one embodiment of the present invention and the conventional copper-chromium contacts.

In FIG. 4, the content and the diameter of the chromium powder in the copper-chromium contacts a, b, c, are as follows.

| Symbol | Content of chromium (wt. %) | Diameter of chromium powder (μm) |
|---|---|---|
| a | 25 | 30 (50%) 250 (50%) |
| b | 25 | 75 (50%) 250 (50%) |
| c | 75 | 75 |

As shown in FIG. 4, the copper-chromium contact of one embodiment of the present invention, (the condition a) had excellent characteristics of low melt bonding property and low chopping current and high withstand voltage.

The other characteristics of the copper-chromium contact of the present invention such as the interrupting property for large current, the arcing time for interrupting, the contact resistance, the erosion of the contact and the hardness have been tested, to find superior characteristics in comparison with those of the conventional copper-chromium contacts.

It has been confirmed that the copper-chromium contact prepared by incorporating the chromium powder having a diameter of 30 μm and the chromium powder having a diameter of 250μm into the matrix has excellent characteristics as the contact having high withstand voltage, large current durability and low chopping current.

Although the copper-chromium contacts have been discussed, the hgih melting point metal powder of W, Mo, Ir or Co can be used instead of the chromium powder to obtain a contact having high withstand voltage, large current durability, and low chopping current.

The copper-chromium contact of the present invention is preferably prepared by a melt-casting process at the temperature of lower than a melting point of the high melting point metal powder in a powder metallurgy.

What is claimed is:

1. A contact for a vacuum circuit interrupter which is prepared by uniformly distributing, in a copper matrix, at least 10 wt.% of a high melting point metal powder having a melting point higher than 1450° C. and selected from the group consisting of Cr, Fe, Co and mixtures thereof, wherein said powder is a mixture of two different particle sizes wherein one particle size has a diameter of (1) 80–300 μm and the other particle size has a diameter of (2) less than 30 μm.

2. The contact according to claim 1, wherein the high melting point metal powder is Cr.

3. A contact according to claim 1 wherein the high melting point metal powder is an alloy having a main component selected from the group consisting of Cr, Fe and Co.

4. A contact according to claim 1 wherein the high melting point metal powder is an alloy having a main component selected from the group consisting of Cr, Fe and Co.

5. A contact according to claim 1 wherein the contact is formed by a powder metallurgy process.

6. A contact according to claim 1 wherein the contact is formed by a melt-casting process at a temperature of lower than a melting point of the high melting point metal powder.

* * * * *